US006226021B1

(12) United States Patent
Kobayashi et al.

(10) Patent No.: US 6,226,021 B1
(45) Date of Patent: May 1, 2001

(54) IMAGE FORMING METHOD OF THERMAL TRANSFER PRINTER

(75) Inventors: Hiroshi Kobayashi; Hiroyoshi Zama; Hiromitsu Takahashi, all of Iwate-ken (JP)

(73) Assignee: Alps Electric Co., Ltd. (JP)

( * ) Notice: Subject to any disclaimer, the term of this patent is extended or adjusted under 35 U.S.C. 154(b) by 0 days.

(21) Appl. No.: 09/281,174

(22) Filed: Mar. 30, 1999

(30) Foreign Application Priority Data

Apr. 3, 1998 (JP) ..... 10-091276
Apr. 8, 1998 (JP) ..... 10-095986

(51) Int. Cl.[7] ..... B41J 2/355
(52) U.S. Cl. ..... 347/183
(58) Field of Search ..... 347/180, 181, 347/182, 183, 217; 400/120.05, 120.06, 120.07

(56) References Cited

U.S. PATENT DOCUMENTS 4,805,033 2/1989 Nishikawa ..... 358/298
4,809,063 2/1989 Moriguchi et al. ..... 358/535
5,467,120 11/1995 Sadaki et al. ..... 347/171
5,721,578 2/1998 Nakai et al. ..... 347/183
5,982,405 * 11/1999 Sasaki et al. ..... 347/176
6,005,596 * 12/1999 Yoshida et al. ..... 347/176

FOREIGN PATENT DOCUMENTS 0304289 2/1989 (EP) .
0517263 12/1992 (EP) .
0660586 6/1995 (EP) .

* cited by examiner

*Primary Examiner*—N. Le
*Assistant Examiner*—K. Feggins
(74) *Attorney, Agent, or Firm*—Brinks Hofer Gilson & Lione

(57) ABSTRACT

In an image forming method in which a dither matrix comprised of a plurality of dots are used to record one pixel and an image having multistage gradations is recorded by changing the diameter of this dot, a threshold value of a dither matrix in one pixel is arranged such that each dot is sequentially plotted in the scanning direction of a thermal head. Further, in response to gradations, an image is recorded without using a dither matrix of a threshold value in which an energization time of a thermal head becomes discontinuous.

4 Claims, 6 Drawing Sheets

IMAGE FORMING METHOD OF THERMAL TRANSFER PRINTER

BACKGROUND OF THE INVENTION

1. Field of the Invention

The present invention relates to an image forming method of a thermal transfer printer, and particularly to an image forming method of a thermal transfer printer in which a color image having multistage gradations is recorded by using resin-based inks.

2. Description of the Prior Art

In general, in a thermal transfer printer, a paper is supported in front of a platen, and a thermal head having a plurality of heating elements formed thereon is mounted on a carriage. Under the condition that an ink ribbon and the paper are sandwiched between the thermal head and the platen, the thermal head is reciprocated along the platen together with the carriage to supply the ink ribbon. The heating elements of the thermal head are selectively energized based on recording information to partly transfer inks of the ink ribbon onto a paper, thereby resulting in an image such as a desired character being recorded on the paper. Such thermal transfer printer is considerably widespread as an output apparatus for a computer, a word processor or the like because it is high in recording quality, low in noise, low in cost and is easy in maintenance.

As a conventional thermal transfer printer, there is known a thermal transfer printer in which an ink ribbon having a wax-based ink with fusion property coated on base such as a plastic film is used to record an image on a paper. Then, when an image having multistage gradations is recorded by using such wax-based ink, there is used a dither method or the like. Recently, in accordance with an increasing demand of a color image having a higher resolution, by controlling energy to energize heating elements of a thermal head to adjust heat energy applied to inks and controlling fused areas of inks in response to image information, an image having multistage gradations is recorded on a micro-porous paper in which a micro-porous layer, each pore having a diameter of 2 to 10 $\mu$m, is formed on the surface.

However, in the conventional thermal transfer printer, when an image is recorded by using the above-mentioned wax-based ink, since the ink itself is soft, if a recorded image is rubbed, then the recorded image is deteriorated.

Moreover, when the micro-porous paper is in use, the ink is permeated into the micro-porous layer so that a clear image cannot be obtained due to the influence of the surface characteristic of the micro-porous paper.

Moreover, it has been proposed that an image is recorded by using an ink ribbon having a resin-based single-layer ink layer. When an image is recorded by using this resin-based ink, although a problem in which a recorded image is deteriorated by rubbing can be solved and a clear image having an excellent fastness can be obtained, the resin-based ink is poor in transfer sensitivity as compared with the wax-based ink so that an accurate transfer cannot be obtained particularly in the low-density portion. As a result, a jaggy is produced in the recorded image due to a transfer failure or the like. There is then the problem that a clear recorded image cannot be obtained.

SUMMARY OF THE INVENTION

It is an object of the present invention to provide an image forming method of a thermal transfer printer in which an image can be accurately transferred even onto a low-density portion by using a resin-based ink having an excellent fastness and in which a clear image having multistage gradations can be recorded.

That is, in an image forming method of a thermal transfer printer in which a dither matrix comprised of a plurality of dots are used to record one pixel and a plurality of heating elements of a thermal head are selectively energized to change dot diameters to transfer resin-based inks onto a paper, thereby recording an image having multistage gradations, the image forming method of a thermal transfer printer is characterized in that a threshold value of the dither matrix in one pixel is arranged such that each dot is sequentially plotted in the scanning direction of the thermal head.

Then, it is another object of the present invention to provide an image forming method of a thermal transfer printer using the above-mentioned arrangement in which dots are continuously formed in one pixel and a clear image in which dots are satisfactorily made continuous can be recorded efficiently so that, even when the resin-based ink is used, a proper and clear image having multistage gradations can be recorded.

Further, in an image forming method of a thermal transfer printer according to the present invention, the order in which each dot between respective pixels is plotted is comprised of threshold values continuous in the scanning direction of the thermal head.

Then, it is a further object of the present invention to provide an image forming method of a thermal transfer printer in which dots can be continuously formed between the pixels so that a clear image in which respective pixels are satisfactorily made continuous can be recorded efficiently.

Further, in image forming method of a thermal transfer printer according to the present invention, a color image is recorded by resin-based inks of at least three colors of cyan, magenta and yellow.

Then, it is a still further object of the present invention to provide an image forming method of a thermal transfer printer in which a full color image can be properly recorded by the resin-based inks of at least three colors of cyan, magenta and yellow.

Further, in an image forming method of a thermal transfer printer in which a dither matrix comprised of a plurality of dots are used to record one pixel and a plurality of heating elements of a thermal head are selectively energized to change dot diameters to transfer resin-based inks onto a paper, thereby recording an image having multistage gradations, the image forming method of a thermal transfer printer is characterized in that an image is recorded in response to gradations without using a dither matrix of a threshold value in which an energization time of the thermal head becomes discontinuous.

Then, it is a still further object of the present invention to provide an image forming method of a thermal transfer printer in which gradations can be accurately expressed in proportion to an energization time of a thermal head and an image having multistage gradations can be recorded properly.

Furthermore, in image forming method of a thermal transfer printer according to the present invention, a color image is recorded by resin-based inks of at least three colors of cyan, magenta and yellow.

Then, it is a yet further object of the present invention to provide an image forming method of a thermal transfer printer in which a full color image can be properly recorded by the resin-based inks of three colors of cyan, magenta and yellow.

DETAILED DESCRIPTION OF THE PREFERRED EMBODIMENT

An embodiment according to the present invention will hereinafter be described with reference to FIGS. 1 to 13.

FIGS. 1 to 13 show an image forming method according to an embodiment of the present invention. In this embodiment, when a full color image is recorded on the basis of image information inputted from a suitable device such as a host computer and an image reader, image information is color-separated to provide image information of each color of cyan, magenta and yellow, and each heating element of a thermal head is energized under control of recording information of each color, and inks of respective colors of cyan, magenta and yellow are sequentially transferred, thereby resulting in a full color image being recorded. In this case, according to this embodiment, the inks of respective colors might be resin-based inks.

Then, in this embodiment, when such a full color image is recorded, a full color image is recorded in a multistage gradation recording fashion by pixels using dither matrixes.

Figure 1:
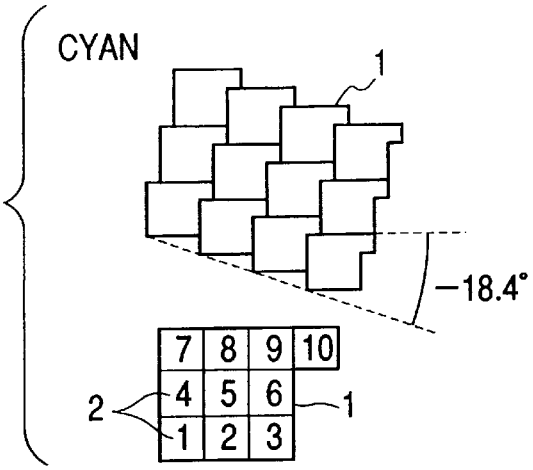
FIG. 1 is an explanatory diagram showing a dither matrix of cyan used in an image forming method according to an embodiment of the present invention.
Figure 2:
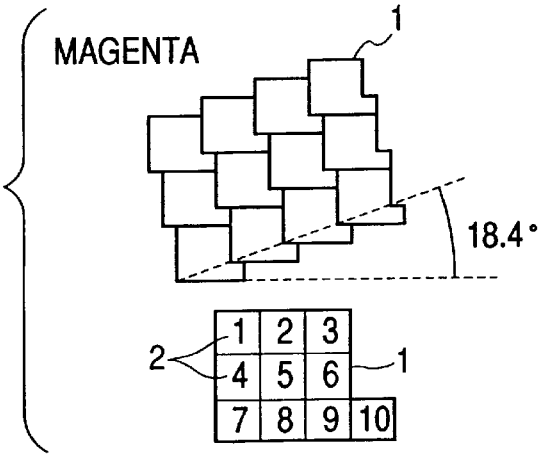
FIG. 2 is an explanatory diagram showing a dither matrix of magenta used in an image forming method according to an embodiment of the present invention.
Figure 3:
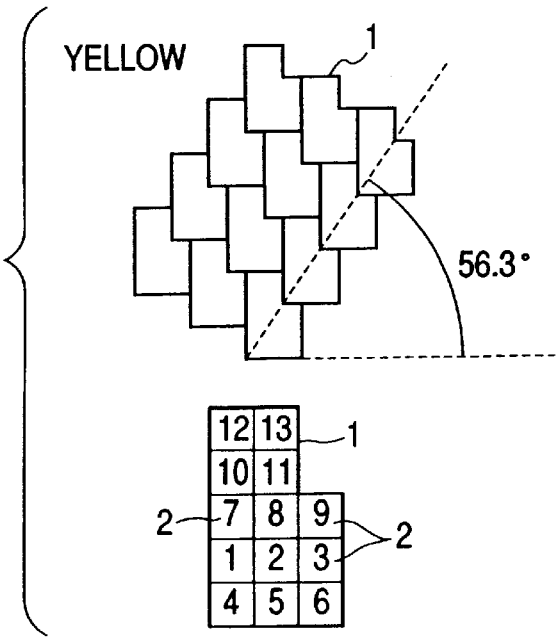
FIG. 3 is an explanatory diagram showing a dither matrix of yellow used in an image forming method according to an embodiment of the present invention.

That is, FIGS. 1 to 3 show dither matrixes of pixels of respective colors. As shown in FIG. 1, a dither matrix 1 of color of cyan comprises 10 dots 2 in which one dot 2 is added to one upper portion of 3×3 dots 2. A pixel of the dither matrix 1 of such shape is continuously recorded, whereby a color of cyan is recorded with a rightwardly-descending screen angle of −18.4°.

As shown in FIG. 2, a dither matrix 1 of color of magenta comprises 10 dots 2 in which one dot 2 is added to one lower portion of 3×3 dots 2. A pixel of the dither matrix 1 of such shape is continuously recorded, whereby a color of magenta is recorded with a rightwardly-ascending screen angle of 18.4°.

As shown in FIG. 3, a dither matrix 1 of yellow comprises 13 dots 2 in which 2×2 dots 2 are added to upper portions of 3×3 dots 2. A pixel of the dither matrix 1 of such shape is continuously recorded, whereby a color of yellow is recorded with a rightwardly-ascending screen angle of 56.3°.

Further, in this embodiment, by changing the diameter of the dot 2 recorded on the dot 2 of each pixel, it becomes possible to effect the recording of 15 gradations in one dot 2.

Figure 4:
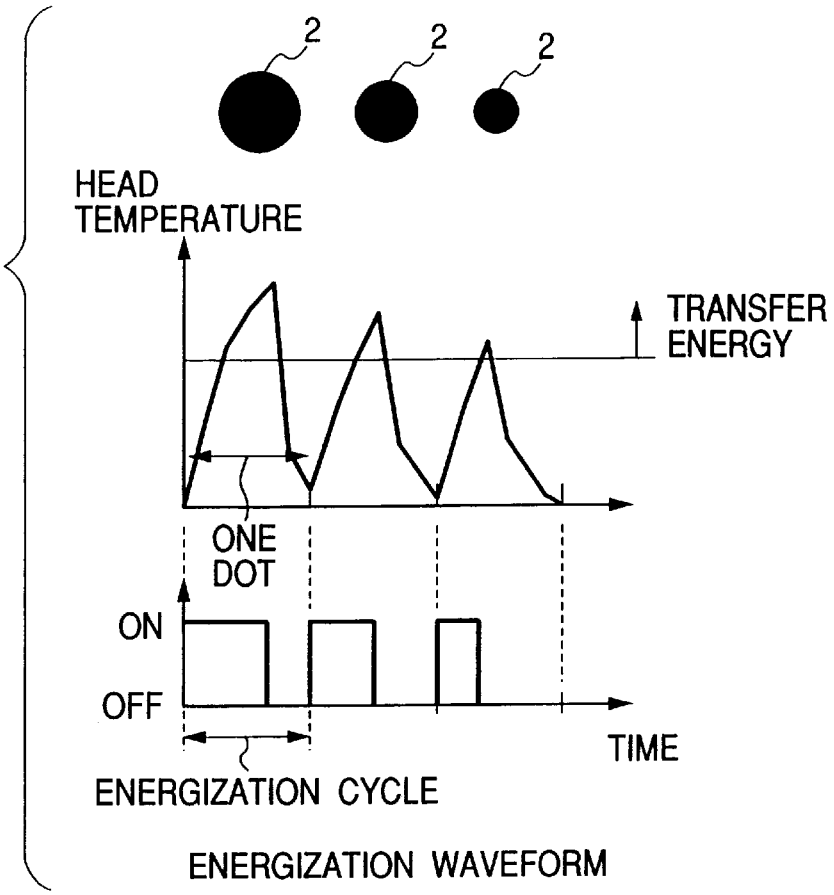
FIG. 4 is an explanatory diagram showing the manner in which a thermal head is energized under control in an image forming method according to the present invention.

FIG. 4 shows the manner in which an energization of a thermal head is controlled in order to execute a multistage gradation. In this embodiment, by controlling an energization time of a thermal head in 15 stages, a temperature of the thermal head is controlled. An ink transfer amount is adjusted by controlling the temperature of the thermal head. That is, when the energization time of one dot 2 is decreased, the temperature of the thermal head increases very slightly in excess of the transfer energy so that the ink transfer amount decreases. Conversely, when the energization time of one dot 2 increases, the temperature of the thermal head considerably increases in excess of the transfer energy so that the ink transfer amount increases. Thus, when the energization time of one dot 2 is controlled as described above, the diameter of the dot 2 being recorded can be controlled in 15 stages by controlling the ink transfer amount.

As described above, in this embodiment, one dot 2 can be recorded in 15 gradations. Assuming that n is the number of dot 2 in one pixel, then the number of gradations 1 can be expressed from a theory standpoint by the following equation:

$$l=n\times 15+1$$

Since the number n of the dot 2 in one pixel of colors of cyan and magenta are 10, it is possible to effect the recording expressed as:

$$10\times 15+1=151 \text{ gradations}$$

Also, since the number n of the dot 2 in one pixel of color of yellow is 13, it is possible to effect the recording expressed as:

$$13\times 15+1=196 \text{ gradations}$$

Figure 5:
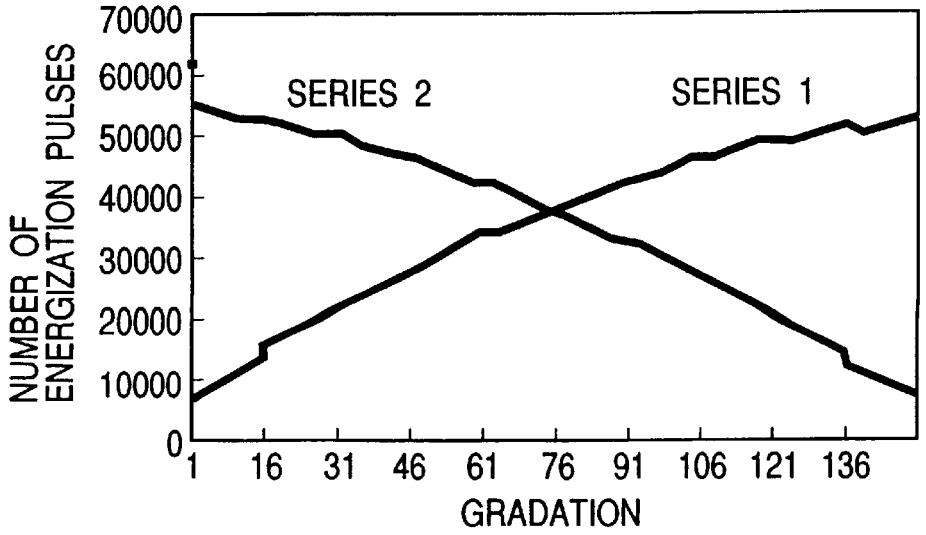
FIG. 5 is a characteristic graph showing a relationship between gradations of color dither matrixes of cyan and magenta and corresponding energization times of a thermal head.
Figure 6:
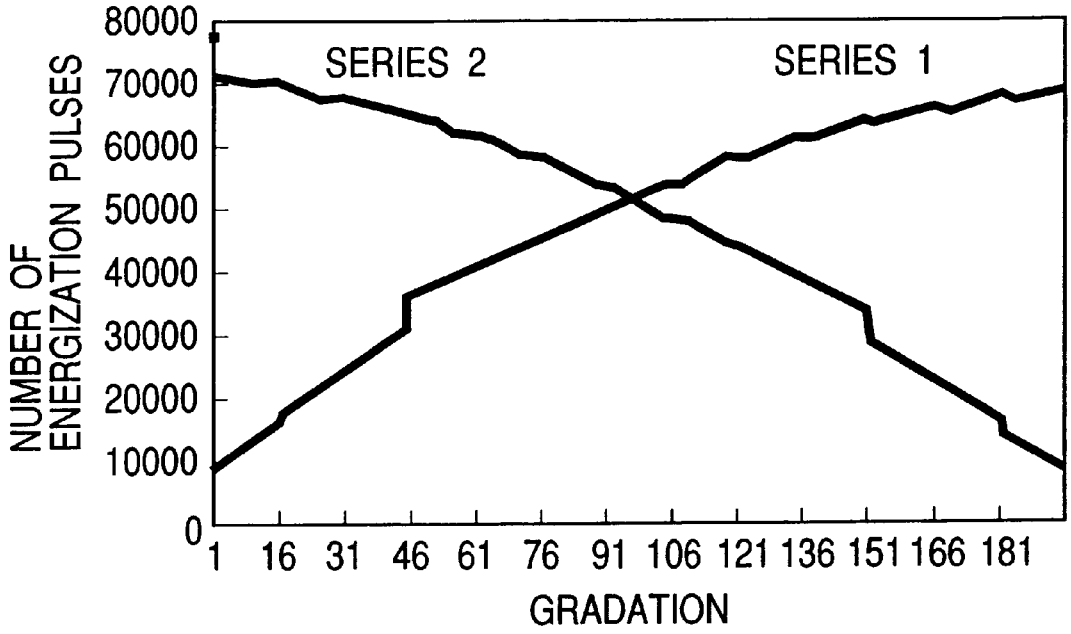
FIG. 6 is a characteristic graph showing a relationship between a gradation of color dither matrix of yellow and corresponding energization times of a thermal head.

FIGS. 5 and 6 show a relationship of energization times of the thermal head corresponding to the gradations of dither matrixes 1 of colors of cyan, magenta and color of yellow. A study of these characteristic graphs reveals that, although the energization time of the thermal head should become proportional to the gradations of the dither matrix 1, heat is accumulated in a substrate or the like because of the energization of the thermal head and therefore heat accumulated therein should be corrected. When the accumulated heat is corrected by controlling the energization time of the thermal head, there is produced a portion in which the energization time of the thermal head becomes discontinuous in response to the gradations of the dither matrix 1. As a consequence, even when the energization time of the thermal head is controlled, there is then the problem that the gradation of the dither matrix 1 cannot be recorded smoothly.

Figure 7:
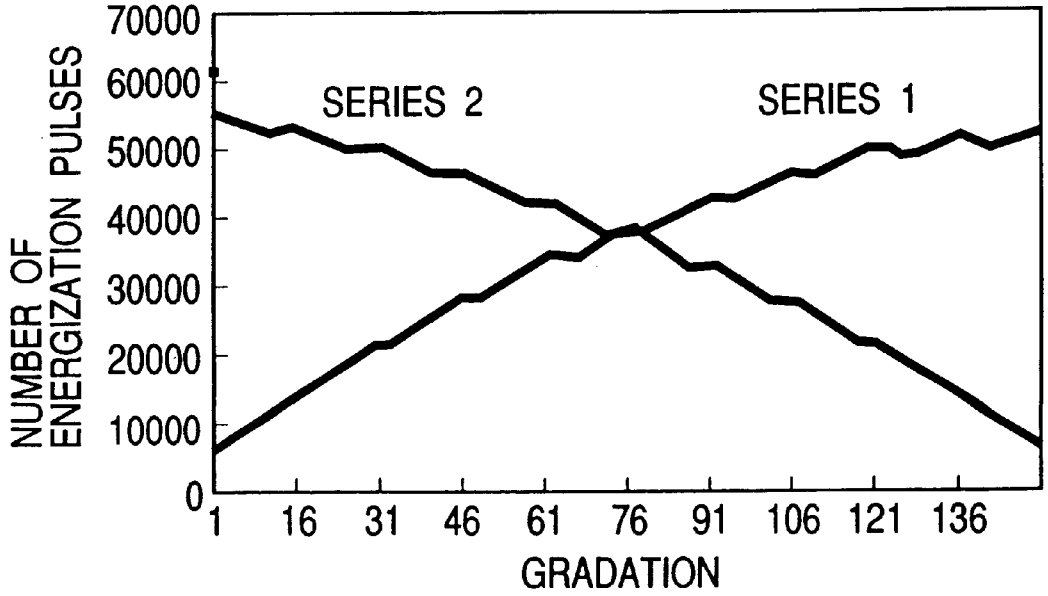
FIG. 7 is a characteristic graph showing measured results obtained by correcting a relationship between a gradation of the dither matrix and energization time of a thermal head shown in FIG. 5.
Figure 8:
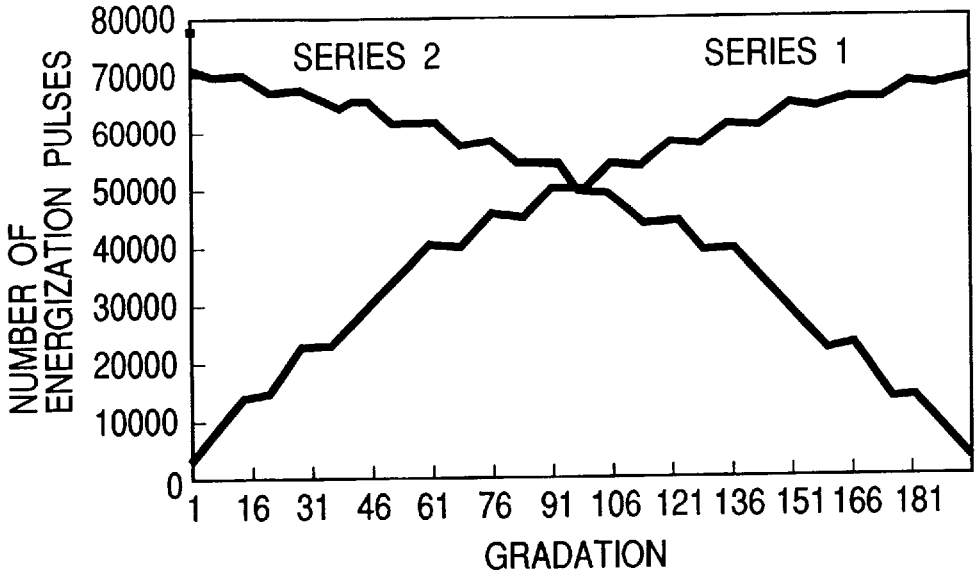
FIG. 8 is a characteristic graph showing measured results obtained by correcting a relationship between a gradation of the dither matrix and energization time of a thermal head shown in FIG. 6.

FIGS. 7 and 8 show relationship of the gradation of dither matrix 1 and the energization time of the thermal head obtained when the accumulated heat is corrected by changing a set value in order to remove the portions in which the energization times of the thermal head become discontinuous shown in FIGS. 5 and 6. A study of these characteristic graphs reveals that, although the portions in which the energization time becomes discontinuous can be removed, there is then the problem that a jaggy is produced in other normal portions, thereby making it impossible to smoothly record all gradations.

Figure 9:
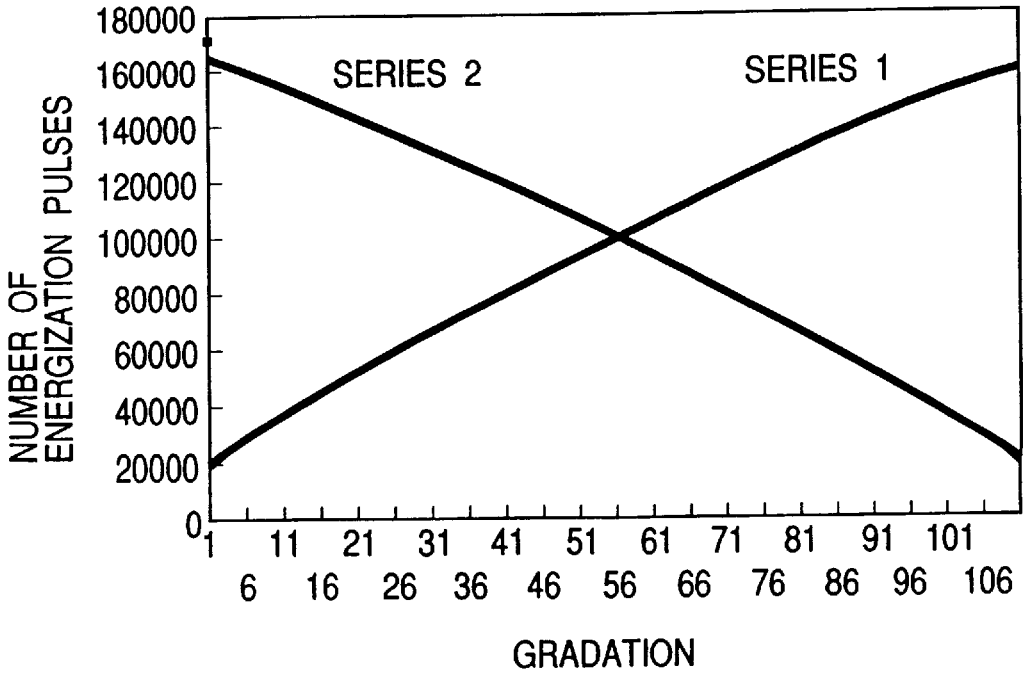
FIG. 9 is a characteristic graph showing a relationship between gradations of color dither matrixes of cyan and magenta and corresponding energization times of a thermal head obtained when a discontinuous portion of an energization time is removed in an image forming method according to the present invention.
Figure 10:
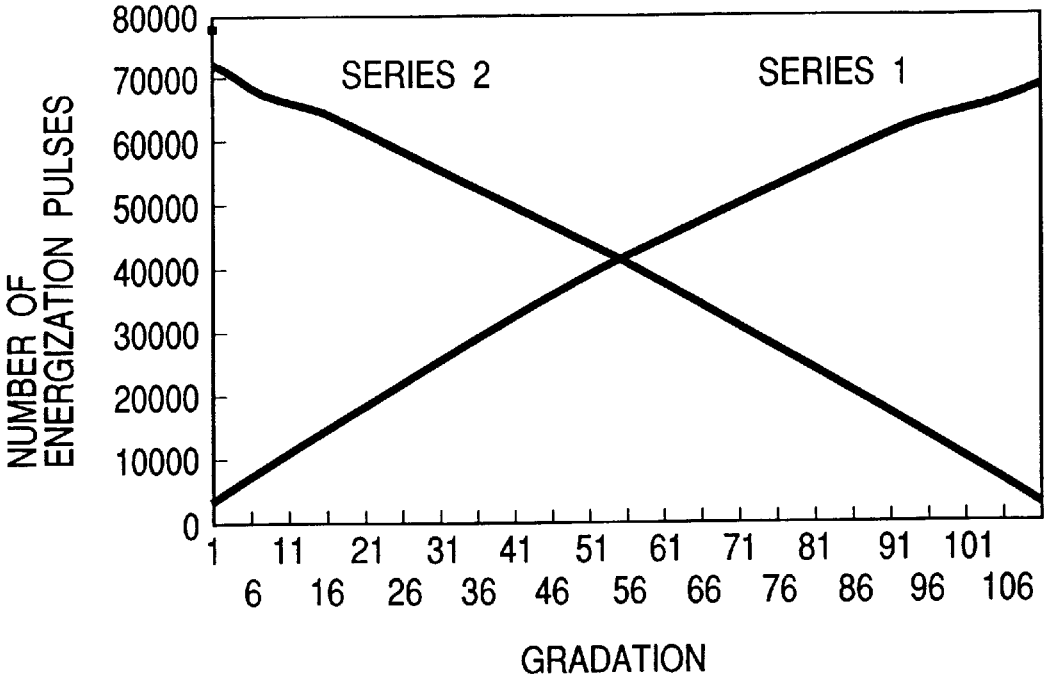
FIG. 10 is a characteristic graph showing a relationship between a gradation of color dither matrix of yellow and corresponding energization times of a thermal head obtained when a discontinuous portion of an energization time is removed in an image forming method according to the present invention.

Therefore, according to this embodiment, as shown in FIGS. 9 and 10, by changing the set value of the energization time of the thermal head, the energization time can be controlled in such a manner that a discontinuous portion of energization time is removed so that only a portion in which an energization time is continuous is used relative to the gradation. Accordingly, although the number of gradations that can be recorded decreases relative to the energization time, gradations can be expressed accurately in proportion to the energization time. When the energization time is controlled as described above, as mentioned before, the respective colors of cyan and magenta having 151 gradations can be recorded from a theory standpoint. In actual practice, cyan and magenta having approximately 110 gradations can be recorded. Although the color of yellow having 196 gradations can be recorded from a theory standpoint, the color of yellow having approximately 108 gradations can be recorded in actual practice.

Figure 11:
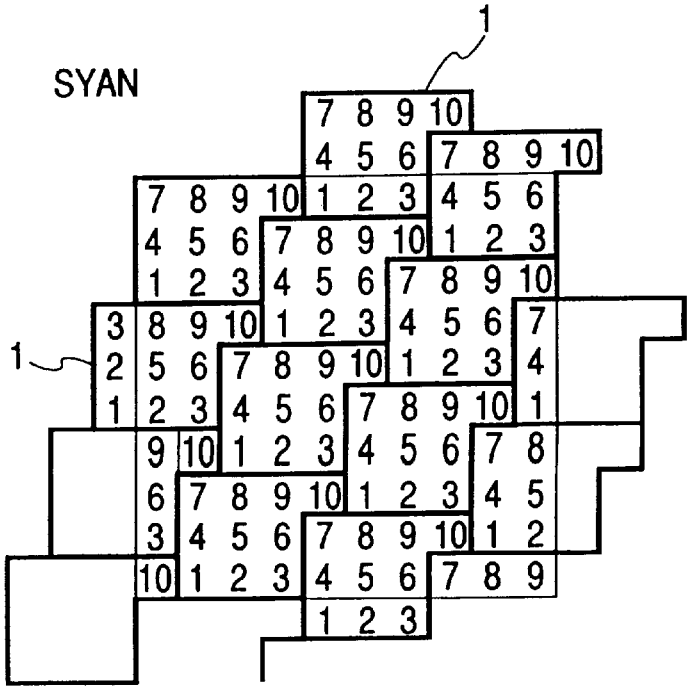
FIG. 11 is an explanatory diagram showing each dither matrix of cyan in an image forming method according to the present invention.
Figure 12:
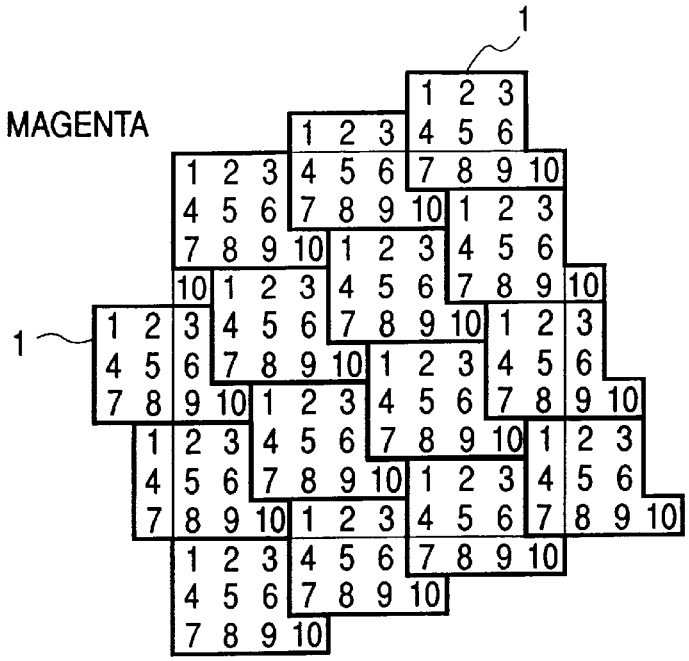
FIG. 12 is an explanatory diagram showing each dither matrix of magenta in an image forming method according to the present invention.
Figure 13:
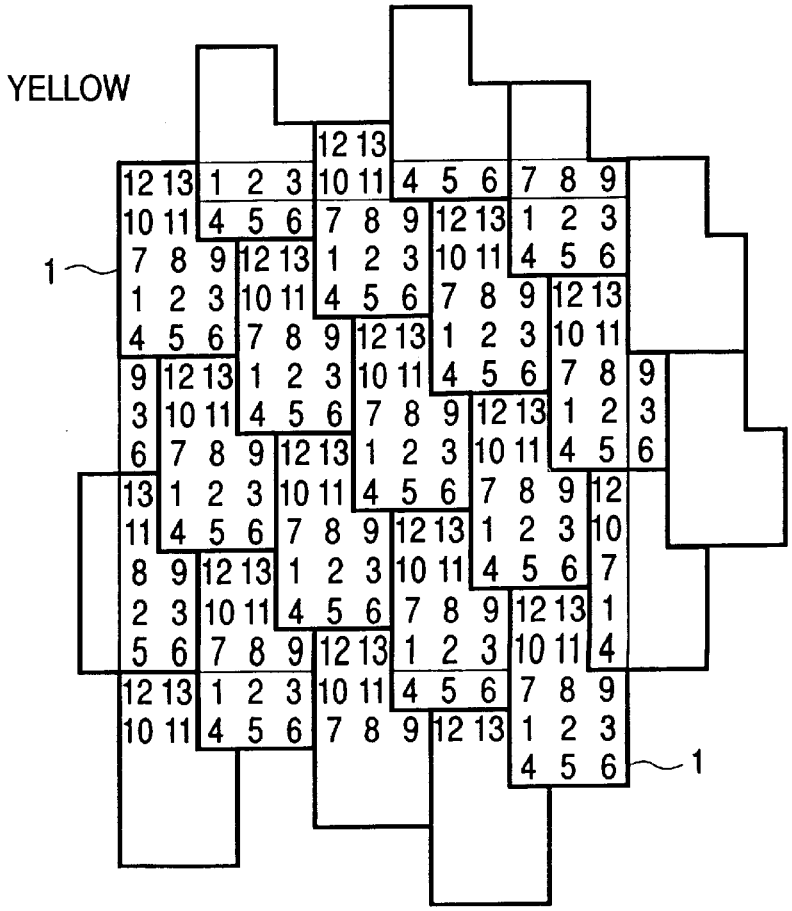
FIG. 13 is an explanatory diagram showing each dither matrix of yellow in an image forming method according to the present invention.

Further, in this embodiment, as shown in FIGS. 11 to 13, the threshold value of the dither matrix 1 in one pixel is set in such a manner that the respective dots 2 are sequentially plotted in the scanning direction of the thermal head. Further, in this embodiment, the order in which the dots 2 are plotted as described above is comprised of threshold values continuous in the scanning direction of the thermal head, between the respective pixels.

Specifically, in the dither matrix 1 of the color of cyan, as shown in FIG. 1, since each pixel has the screen angle in which each pixel is shifted by one dot each in the rightwardly-descending direction, the dot 2 is sequentially plotted from the dot 2 at the lowermost column to the scanning direction of the thermal head. Therefore, in the respective pixels, as shown in FIG. 11, the above-mentioned plotted order is comprised of threshold values continuous in the scanning direction of the thermal head.

In the dither matrix 1 of the color of magenta, as shown in FIG. 2, since each pixel has a screen angle in which each pixel is shifted by one dot each in the rightwardly-ascending direction, the dot 2 is sequentially plotted from the dot 2 at the uppermost column in the scanning direction of the thermal head. Therefore, in the respective pixels, as shown in FIG. 12, the above-mentioned plotted order is comprised of threshold values continuous in the scanning direction of the thermal head.

Further, in the dither matrix 1 of the color of yellow, as shown in FIG. 3, since each pixel has the screen angle in which each pixel is shifted by three dots each in the rightwardly-ascending direction, the dot 2 is sequentially plotted in the upper direction such that the dot 2 is plotted from the dot 2 on the second column from below, then the dot 2 is plotted from the dot 2 on the lowermost column from below and then the dot 2 is plotted from the dot 2 on the third column from below. Accordingly, in the respective pixels, as shown in FIG. 13, the above-mentioned plotted order is comprised of threshold values substantially continuous in the scanning direction of the thermal head.

In this case, according to this embodiment, since the resin-based ink is used as the transfer ink, an ink transfer sensitivity is low as compared with the case in which a wax-based ink is used as the transfer ink. Accordingly, when the recording is made in such a manner that each dot 2 of the dither matrix 1 is plotted by using the conventional plotting means of the dot 2 such as a dot-dispersion type, the dots 2 are not continuous satisfactorily and the dots 2 which are located at the distant positions are transferred. As a result, since the transfer sensitivity is not satisfactory, there occurs a transfer failure in which the ink cannot be transferred to the recording paper. Thus, there is obtained only a jagged image.

However, according to this embodiment, since the threshold value of the dither matrix 1 in one pixel is arranged such that each dot 2 is sequentially plotted in the scanning direction of the thermal head and the order in which the dot 2 is plotted is comprised of the threshold values continuous in the scanning direction of the thermal head, between the respective pixels, the respective dots 2 can be continuously formed in one pixel and between the respective pixels. As a result, the respective dots 2 are made continuous smoothly so that the respective dots 2 can be properly transferred to the recording paper, thereby making it possible to effect a beautiful recording with high efficiency.

Therefore, according to the present invention, since an image is recorded without using the dither matrix of the threshold value in which the energization time of the thermal head becomes discontinuous, the gradations can be expressed accurately in proportion to the energization time of the thermal head. As a consequence, even when the resin-based ink is in use, a proper and clear image can be recorded with multistage gradations, thereby making it possible to considerably improve a recording quality.

Incidentally, the present invention is not limited to the above-mentioned embodiment and may be modified if necessary.

As described above, in the color image forming method of a thermal transfer printer according to the first invention, since the threshold value of the dither matrix in one pixel is arranged such that the order in which each dot is plotted is sequentially plotted in the scanning direction of the thermal head, in one pixel, respective dots can be satisfactorily continuously recorded with high efficiency. As a result, even when the resin-based ink is in use, a proper and clear image can be recorded with multistage gradations, thereby making it possible to considerably improve a recording quality.

Also, according to the second invention, since the order in which dots are plotted is comprised of the threshold values continuous in the scanning direction of the thermal head, between the respective pixels, dots in each pixel can be satisfactorily continuously recorded with high efficiency. As a result, even when the resin-based ink is in use, a proper and clear image can be recorded with multistage gradations, thereby making it possible to considerably improve a recording quality.

Further, according to the third invention, there can be achieved the effect in which a full color image can be properly recorded by the resin-based inks of three colors of cyan, magenta and yellow.

Furthermore, in the image forming method of thermal transfer printer according to the fourth invention, since an image is recorded without using the dither matrix of the threshold value in which the energization time of the thermal head becomes discontinuous, the gradations can be expressed accurately in proportion to the energization time of the thermal head. As a consequence, even when the resin-based ink is in use, a proper and clear image can be recorded with multistage gradations, thereby making it possible to considerably improve a recording quality.

Furthermore, according to the fifth invention, there can be achieved the effect in which a full color image can be properly recorded by the resin-based inks of three colors of cyan, magenta and yellow.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. In an image forming method of a thermal transfer printer for recording a color image by resin-based inks of at least three colors of cyan, magenta and yellow, said method comprising:

using a dither matrix comprised of a plurality of dots to record one pixel;

selectively energizing a plurality of heating elements of a thermal head, by controlling an energization time of said heating elements, to change dot diameters of the resin-based inks transferred onto a paper, thereby permitting the recordation of an image having multistage gradations; and arranging a threshold value of said dither matrix in one pixel such that each dot is sequentially plotted in the scanning direction of said thermal head, wherein a pixel of cyan comprises a dither matrix of 10 dots in which 1 dot is added to an upper-right portion of a block of 3×3 dots, said cyan color being recorded with a rightwardly-descending screen angle, and in which the pixel of cyan is sequentially plotted from a lowermost column of the dither matrix relative to the scanning direction of the thermal head, wherein a pixel of magenta comprises a dither matrix of 10 dots in which 1 dot is added to a lower-right portion of a block of 3×3 dots, said magenta color being recorded with a rightwardly-ascending screen angle, and in which the pixel of magenta is sequentially plotted from an uppermost column of the dither matrix relative to the scanning direction of the thermal head, and wherein a pixel of yellow comprises a dither matrix of 13 dots in which a block of 2×2 dots are added to an upper portion of a block of 3×3 dots, said yellow color being recorded with a rightwardly-ascending screen angle, and in which the pixel of yellow is sequentially plotted from a second lowermost column of the dither matrix relative to the scanning direction of the thermal head, and then from a lowermost column of the dither matrix, and then from a third lowermost column of the dither matrix.

2. An image forming method of a thermal transfer printer as claimed in claim 1, wherein said step of arranging comprises ordering the plotting of each dot such that said order in which each dot is plotted is comprised of threshold values continuous in the scanning direction of said thermal head.

3. In an image forming method of a thermal transfer printer for recording a color image by resin-based inks of at least three colors of cyan, magenta and yellow, said method comprising:

using a dither matrix comprised of a plurality of dots to record one pixel;

selectively energizing a plurality of heating elements of a thermal head, by controlling an energization time of said heating elements, to change dot diameters of the resin-based inks transferred onto a paper, thereby permitting the recordation of an image having multistage gradations; and recording the image in response to multistage gradations by using a dither matrix having a threshold value that has been adjusted to remove discontinuous portions of the energization time of said thermal head, wherein a pixel of cyan comprises a dither matrix of 10 dots in which 1 dot is added to an upper-right portion of a block of 3×3 dots, said cyan color being recorded with a rightwardly-descending screen angle, and in which the pixel of cyan is sequentially plotted from a lowermost column of the dither matrix relative to the scanning direction of the thermal head, wherein a pixel of magenta comprises a dither matrix of 10 dots in which 1 dot is added to a lower-right portion of a block of 3×3 dots, said magenta color being recorded with a rightwardly-ascending screen angle, and in which the pixel of magenta is sequentially plotted from an uppermost column of the dither matrix relative to the scanning direction of the thermal head, and wherein a pixel of yellow comprises a dither matrix of 13 dots in which a block of 2×2 dots are added to an upper portion of a block of 3×3 dots, said yellow color being recorded with a rightwardly-ascending screen angle, and in which the pixel of yellow is sequentially plotted from a second lowermost column of the dither matrix relative to the scanning direction of the thermal head, and then from a lowermost column of the dither matrix, and then from a third lowermost column of the dither matrix.

4. An image forming method of a thermal transfer printer as claimed in claim 3, wherein the threshold value of said dither matrix in one pixel is arranged such that each dot is sequentially plotted in the scanning direction of said thermal head.

* * * * *